US012560081B2

(12) United States Patent
Zeng et al.

(10) Patent No.: US 12,560,081 B2
(45) Date of Patent: Feb. 24, 2026

(54) DYNAMIC PREDICTION METHOD FOR SURFACE PUMP PRESSURE BASED ON SPATIO-TEMPORAL DATA FEATURES

(71) Applicant: Southwest Petroleum University, Chengdu (CN)

(72) Inventors: Fanhui Zeng, Chengdu (CN); Yu Zhang, Chengdu (CN); Xiaoyang Du, Chengdu (CN); Dagan Hu, Chengdu (CN); Jianchun Guo, Chengdu (CN)

(73) Assignee: Southwest Petroleum University, Chengdu (CN)

( * ) Notice: Subject to any disclaimer, the term of this patent is extended or adjusted under 35 U.S.C. 154(b) by 0 days.

(21) Appl. No.: 19/183,020

(22) Filed: Apr. 18, 2025

(65) Prior Publication Data

US 2026/0022634 A1 Jan. 22, 2026

(30) Foreign Application Priority Data

Jul. 19, 2024 (CN) ..... 202410973160.8

(51) Int. Cl.
*E21B 47/06* (2012.01)

(52) U.S. Cl.
CPC ..... *E21B 47/06* (2013.01); *E21B 2200/22* (2020.05)

(58) Field of Classification Search
CPC ..... E21B 47/06
See application file for complete search history.

(56) References Cited

U.S. PATENT DOCUMENTS

2020/0065677 A1* 2/2020 Iriarte Lopez ..... E21B 49/006
2021/0350208 A1 11/2021 Wang

FOREIGN PATENT DOCUMENTS

CN 107229752 A 10/2017
CN 111734383 A * 10/2020 ..... G06F 30/20
CN 111734383 B 10/2020
CN 114189478 B 3/2022
(Continued)

OTHER PUBLICATIONS

Liu "CN-116894399-A"; Oct. 17, 2023; pp. pp. 1-12 (Year: 2023).*
(Continued)

*Primary Examiner* — Michael J Dalbo
*Assistant Examiner* — Kaleria Knox
(74) *Attorney, Agent, or Firm* — JEEN IP LAW, LLC

(57) ABSTRACT

A dynamic prediction method for surface pump pressure based on spatio-temporal data features includes: S1. obtaining original fracturing treatment data and formation evaluation data of a plurality of wells; S2. extracting fracturing treatment data from a prepad fluid initiation stage to a shut-down stage in the fracturing treatment data; S3. constructing time series data with the fracturing treatment data, and construct active independent variable data by combining the fracturing treatment data and formation evaluation data; S4. establishing a hybrid neural network model and a LightGBM gradient boosting model; S5. training the hybrid neural network model and the LightGBM gradient boosting model with the time series data and the active independent variable; S6. obtaining fracturing treatment data of a new fracturing well, and predicting with the trained models; and S7. initializing weights of the prediction models, updating and iterating the weights, and obtaining a final prediction value.

9 Claims, 6 Drawing Sheets

(56) References Cited

FOREIGN PATENT DOCUMENTS

| | | | | | |
|---|---|---|---|---|---|
| CN | 114398786 | B | | 4/2022 | |
| CN | 115964428 | A | | 4/2023 | |
| CN | 116894399 | A | | 10/2023 | |
| CN | 117910654 | A | | 4/2024 | |
| CN | 118774754 | A | * | 10/2024 | ..... E21B 47/06 |
| WO | 2023151072 | A1 | | 8/2023 | |

OTHER PUBLICATIONS

Su, Quan-sheng "CN-115964428-A", Apr. 14, 2023; pp. 1-7 (Year: 2023).*
Xiong, An-ping "CN-107229752-A", Oct. 3, 2017, pp. 1-9 (Year: 2017).*
Hu, Xiao-dong "CN-114398786-A", Apr. 26, 2022, pp. 1-16 (Year: 2022).*

* cited by examiner

DYNAMIC PREDICTION METHOD FOR SURFACE PUMP PRESSURE BASED ON SPATIO-TEMPORAL DATA FEATURES

CROSS-REFERENCE TO RELATED APPLICATIONS

This application claims priority to Chinese Patent Application No. 202410973160.8, filed on Jul. 19, 2024, which is hereby incorporated by reference in its entirety.

TECHNICAL FIELD

The present invention relates to the technical field of oil and gas field development, and in particular, to a dynamic prediction method for surface pump pressure based on spatio-temporal data features.

BACKGROUND

In the development of modern oil and gas fields, hydraulic fracturing technology is widely used as a key means of increasing production. However, due to the complexity of hydraulic fracturing operations, the fracturing treatment process often faces a variety of safety hazards, among which sand plug is particularly common. Sand plug may not only lead to equipment damage, loss of fracturing fluid and extension of fracturing treatment period, but may even cause casualties in severe cases.

The occurrence of sand plug is affected both by the surface pump pressure during the pre-fracturing stage and by the spatial feature parameters of the fracturing section, and has typical dual-coupling feature of time and space. At present, the technologies used to monitor and prevent sand plug in hydraulic fracturing operations mainly rely on traditional monitoring of wellhead parameters, such as real-time monitoring of key parameters such as bottomhole pressure and flow rate. These parameters may provide preliminary indications of the occurrence of sand plug, but generally do not provide sufficient warning time to take effective preventive measures, and therefore have a limited role in avoiding sand plug. In addition, most of these methods rely on manual identification by technical personnel, which limits the accurate prediction of the specific occurrence time and location of sand plug and reduces the efficiency of dealing with potential sand plug.

In this context, it becomes a major challenge for oil and gas field operators to effectively predict and prevent sand plug risks within the existing technical framework. Therefore, it is of great significance to provide a method that can accurately monitor and predict bottomhole pressure. The bottomhole pressure is continuously monitored and analyzed, so that potential indications of sand plug may be detected in time, and corresponding preventive measures may be taken. This method not only improves the efficiency and accuracy of sand plug prevention, but also greatly reduces operational risks, thereby ensuring the safety and economic benefits of oil and gas field development.

SUMMARY

To more effectively ensure the safety and efficiency of hydraulic fracturing operations in modern oil and gas field development, the present invention provides a dynamic prediction method for surface pump pressure based on spatio-temporal data features, specifically a hybrid neural network model (namely, a CNN-LSTM-Attention hybrid neural network model) that integrates a convolutional neural network (CNN), a long short-term memory (LSTM) network and an attention mechanism (Attention), as well as active independent variable technology. Innovatively, this method conducts a detailed analysis of a large amount of field fracturing treatment data by combining machine learning techniques in order to accurately capture the time series dependency and spatial parameter features of the fracturing process. This method includes not only identifying global trends and local fluctuations, but also learning the spatial features of different fracturing formations to achieve real-time monitoring of pressure changes during the fracturing process. According to this method, which effectively improves the safety and efficiency of oil and gas field development, and introduces a new intelligent solution for oil and gas field development.

The present invention can analyze and process a large amount of data generated during the fracturing operation in real time based on a hybrid neural network model, predict the changes in bottomhole pressure in the future by combining time series analysis and an anomaly detection algorithm, and provide accurate multi-step predictions based on historical and real-time data.

Particularly, the spatial active independent variables in the present invention play a crucial role. These spatial variables include not only traditional monitoring parameters such as pump rate, proppant concentration, and proppant ratio, but also other key formation evaluation parameters, wellbore parameters, and the like. These parameters may be actively adjusted in response to the prediction results. In this way, an operator can not only timely check the changes in bottomhole pressure in the future, but also adjust the operation strategy according to the prediction results and the feedback of active independent variables to reduce the bottomhole pressure and avoid the impact of sand plug. Therefore, the prediction method of the present invention provides a more comprehensive and dynamic risk management strategy, which significantly improves the safety and efficiency of oil and gas field development.

A dynamic prediction method for surface pump pressure based on spatio-temporal data features includes the following steps:

- S1. obtaining original fracturing treatment data of a complete fracturing treatment cycle of a plurality of wells and formation evaluation data of a corresponding fracturing formation;
- S2. dividing the complete fracturing treatment cycle into different intervals according to the fracturing treatment data, and extracting original fracturing treatment data from a prepad fluid initiation stage to a shut-down stage;
- S3. preprocessing the fracturing treatment data obtained in the step S2, constructing time series data with a sliding window algorithm, preprocessing and then combining the fracturing treatment data and formation evaluation data to construct active independent variable data, where the fracturing treatment data in the active independent variable data does not include bottomhole pressure;
- S4. establishing a CNN-LSTM-Attention hybrid neural network model for receiving the time series data and a LightGBM gradient boosting model for receiving the active independent variable data;
- S5. respectively training the CNN-LSTM-Attention hybrid neural network model and the LightGBM gradient boosting model with the time series data and the active independent variable obtained in the step S3, and performing hyperparameter optimization on the model training process with a Bayesian optimization algorithm;

S6. obtaining fracturing treatment data and formation evaluation data of a new fracturing well, and performing future multi-step prediction on the bottomhole pressure with the models trained in the step S5 at a sand carrying fluid initiation stage; and S7. initializing weights of prediction results of the CNN-LSTM-Attention hybrid neural network model and the LightGBM gradient boosting model, separately calculating root mean square errors of the two models according to prediction results of each round and a real pressure, and updating and iterating the weights of the prediction results of the two models with a backpropagation method to obtain a final prediction value of the surface pump pressure.

Further, the fracturing treatment data in the step S1 includes: bottomhole pressure, pump rate, proppant concentration, proppant ratio, cumulative proppant volume and cumulative fluid volume; and the formation evaluation data includes: Poisson's ratio, Young's modulus, formation pressure, maximum horizontal principal stress, minimum horizontal principal stress, pore pressure and vertical stress.

Further, the preprocessing obtained fracturing treatment data in the step S3 to obtain preprocessed data includes the following steps:

S31. deleting null values and interpolating missing value data;

S32. standardizing the fracturing treatment data; and

S33. dividing the standardized fracturing treatment data in a certain proportion to obtain a training data set, a verification data set and a test data set.

Further, the constructing time series data with a sliding window algorithm in the step S3 includes the following steps:

constructing a time window by data of a part of time points in the past, where a number of time points contained in each subsequence is a size of the time window; and moving the window forward one or more time units in an entire data set to form a plurality of time windows.

Further, the active independent variable data in the step S3 includes pump rate, proppant concentration, and proppant ratio.

Further, in the step S7, the weights of the prediction results of the two models are updated and iterated with a backpropagation method.

Further, the method further includes step S8:

modifying the active independent variable and checking future predicted pressure to achieve bottomhole pressure regulation and provide a fracturing treatment optimization suggestion.

Further, the step S8 further includes:

S81. obtaining pump rate, proppant concentration, proppant ratio and formation evaluation data of n pieces of data before a time point predicted backward, and taking mean values of the pump rate, the proppant concentration and the proppant ratio;

S82. setting active variable pump rate, proppant concentration and proppant ratio of m time points predicted backward as the mean values obtained in the step S81, remaining the formation evaluation data unchanged, and inputting into a LightGBM gradient boosting model for prediction; and S83. when predicted pressure trends under different fracturing treatment parameters need to be observed, adjusting the obtained mean values and inputting the average values into the LightGBM gradient boosting model for prediction.

In another aspect, the present invention provides a computer device, which includes a memory, a processor, and a computer program stored in the memory and running on the processor, where the processor, when executing the computer program, implements the steps of the dynamic prediction method for surface pump pressure according to any one of the implementations.

In yet another aspect, the present invention provides a computer-readable storage medium, on which a computer program is stored, where the computer program, when executed by a processor, implements the steps of the dynamic prediction method for surface pump pressure according to any one of the implementations.

The present invention provides a dynamic prediction method for surface pump pressure based on spatio-temporal data features, which has the following beneficial technical effects: (1) High-precision prediction: This method can achieve high-precision surface pump pressure prediction by coupling a long short-term memory (LSTM) network and active independent variables. The long short-term memory network optimizes the processing of time series data and improves the accuracy and the reliability of prediction. (2) Real-time monitoring and analysis: This method provides real-time monitoring and analysis capabilities, which can quickly identify abnormal changes in surface pump pressure. This not only helps to find potential problems in time, but also makes timely adjustments based on dynamic changes. (3) Reduced operational risks: By predicting and monitoring surface pump pressure in real time, the present invention significantly reduces the risks during operation and reduces equipment damage and operation interruptions caused by abnormal pressure. (4) Improved working efficiency: With the help of predictive maintenance and active independent variable regulation, this system can reduce downtime and improve overall operational efficiency.

BRIEF DESCRIPTION OF DRAWINGS

To describe the technical solutions in embodiments of the present invention or in the prior art more clearly, the following briefly describes the accompanying drawings for describing embodiments. It is clear that the accompanying drawings in the following description show merely some embodiments of the present invention, and a person of ordinary skill in the art may derive other drawings from these accompanying drawings without creative efforts.

DESCRIPTION OF EMBODIMENTS

Figure 1:
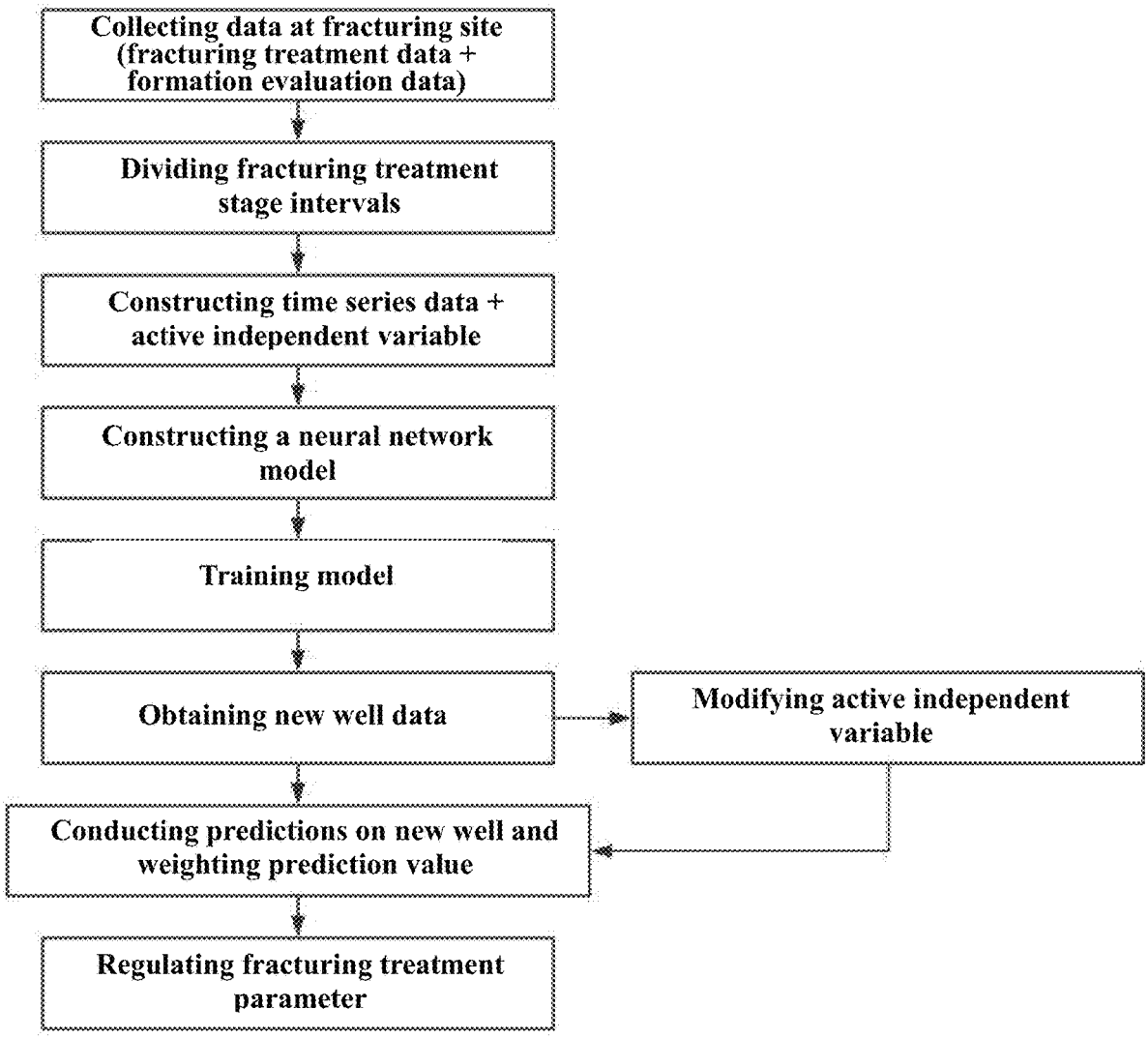
FIG. 1 is a schematic flow chart of a prediction method according to the present invention.

The following clearly and completely describes the technical solutions in embodiments of the present invention with reference to the accompanying drawings in embodiments of the present invention. It is clear that the described embodiments are merely a part rather than all of embodiments of the present invention. Based on the embodiments of the present invention, all other embodiments obtained by those of ordinary skill in the art without creative effort fall within the protection scope of the present invention.

To facilitate understanding of the technical solutions provided by the embodiments of the present application, the background of the present application is first described.

The treatment process of hydraulic fracturing generally includes the following: (1) preparation stage before fracturing; (2) circulating and checking the performance of fracturing truck unit to ensure clearance of a ground flow pipeline; (3) start a high-pressure pump of a fracturing truck and test pressure bearing performance of equipment above a wellhead valve and a ground pipeline; (4) prepad fluid stage, where the prepad fluid is usually clean water or a low-viscosity liquid; (5) pre-frac injection test stage, starting a fracturing truck, and extruding fracturing fluid into the formation based on the pump rate required by design; (6) sand carrying fluid stage, injecting sand carrying fluid (a mixture of fracturing fluid and proppant); (7) after pad fluid stage, pushing the sand carrying fluid in a tubing or casing into the formation; and (8) post-fracturing treatment work: including shut-down, fracture expansion monitoring, post-fracturing analysis, and the like. Of course, in actual working engineering, a technical personnel may adjust the foregoing steps based on a specific situation.

During the fracturing process, if the conveyed proppant cannot enter the formation in time, but is plugged in the artificial fracture, casing or tubing, the pressure of the fracturing fluid suddenly increases and fracturing treatment cannot continue. This phenomenon is called sand plug. Common real-time diagnostic analysis methods include a net pressure fitting method, a surface pump pressure log-log curve method, an "N" value method, a slope inversion method and the like. In practical applications, these traditional methods are often based on subjective and empirical judgments, which can easily lead to misjudgments and fail to provide sufficient warning time.

The sand plug usually occurs after the start of the sand carrying fluid stage. Before the sand carrying fluid stage, the well has already undergone the balling, prepad fluid and other stages, and some fracturing treatment data exist. However, the time from the prepad fluid to the sand carrying fluid stage is not long, and sometimes abnormal bottomhole pressure occurs just after entering the sand carrying fluid stage. To enable operators to predict subsequent bottomhole pressure changes as early as possible, so as to regulate the surface pump pressure in advance and ultimately avoid sand plug, an embodiment of the present invention provides a dynamic prediction method for surface pump pressure based on the existing fracturing treatment data and the corresponding formation evaluation data of the fracturing formation with a machine learning method.

Referring to the schematic flow chart shown in FIG. 1, an embodiment of the present invention provides a dynamic prediction method for surface pump pressure based on spatio-temporal data features, which includes the following steps:

S1. obtaining original fracturing treatment data of a complete fracturing treatment cycle of a plurality of wells in a study area and formation evaluation data of a corresponding fracturing formation;

S2. dividing the complete fracturing treatment cycle into different intervals according to the original fracturing treatment data, and extracting original fracturing treatment data from a prepad fluid initiation stage to a shut-down stage;

S3. preprocessing the obtained fracturing treatment data, constructing time series data with a sliding window algorithm, and combining the fracturing treatment data and/or formation evaluation data to construct active independent variable data;

S4. constructing a CNN-LSTM-Attention hybrid neural network model for receiving the time series data and a LightGBM gradient boosting model for receiving the active independent variable data;

S5. training the CNN-LSTM-Attention hybrid neural network model with the obtained time series data, performing LightGBM gradient boosting model training with the active independent variable data, and performing hyperparameter optimization on the model training process with a Bayesian optimization algorithm;

S6. obtaining the existing fracturing treatment data and formation evaluation data of a fractured target well, and performing future multi-step prediction on the bottomhole pressure with the models trained in the step S5;

S7. initializing weights of prediction results of the two models, separately calculating root mean square errors of the two models according to prediction results of each round and a real pressure, and updating and iterating the weights of the prediction results of the two models with a backpropagation method, so as to obtain a more balanced and accurate final prediction value; and S8. modifying the active independent variable and checking future predicted pressure to achieve bottomhole pressure regulation and provide a fracturing treatment optimization suggestion.

In the step S1, the original fracturing treatment data includes: bottomhole pressure, pump rate, proppant concentration, proppant ratio, cumulative proppant volume and cumulative fluid volume. The bottomhole pressure refers to a pressure formed at a bottomhole due to the high-pressure fracturing fluid injected into the wellbore and squeezed into the reservoir during the fracturing process. In the conventional technology, the bottomhole pressure is generally converted by the wellhead pressure in a unit of MPa. The pump rate refers to a rate or volume of fracturing fluid injected into the well typically in a unit of $m^3$/min, and it is obtained by a fracturing pump. The proppant concentration refers to a mass of proppant (e.g., sand, or haydite) per volume of fracturing fluid, typically in a mass concentration unit, such as kg/$m^3$ or lb/bbl, which represents the mass of proppant in each cubic meter or barrel of fracturing fluid. The proppant ratio refers to a volume ratio of the fracturing fluid to the proppant and is dimensionless. Cumulative proppant volume refers to a total volume or mass of proppant injected into the well during the fracturing operation. The cumulative fluid volume refers to a total volume of fracturing fluid (including prepad fluid, sand carrying fluid and after-pad fluid) injected into the well during the fracturing operation. The occurrence of sand plug is affected by the above original fracturing treatment data, and the foregoing original fracturing treatment data is data that changes with time series.

The formation evaluation data includes: Poisson's ratio, Young's modulus, maximum horizontal principal stress, minimum horizontal principal stress, vertical stress, formation pressure, pore pressure, and the like. The formation evaluation parameters are all conventional parameters used in the art to describe the properties of formation. Details are not described herein again. Generally, the formation evaluation data of different fracturing formations exhibit different features, and therefore the prediction of sand plug is also affected by the spatial feature parameters. The formation pressure and the pore pressure are obtained by a Drill Stem Testing, (DST) drill pipe testing tool.

In the step S2, the main fracturing process is from the prepad fluid stage to the shut-down stage during the fracturing treatment process. The data between these two stages in the fracturing treatment process is extracted as original data.

The preprocessing obtained fracturing treatment data in the step S3 to obtain preprocessed data includes the following steps:

(S31) deleting null values and interpolating missing value data;

(S32) standardizing the fracturing treatment data by the following formula:

$$Z = \frac{(x-\mu)}{\sigma} \tag{1}$$

where Z is a standardized value, $\chi$ is the original data, $\mu$ is a mean of a data set, and $\sigma$ is a standard deviation of the data set;

Further, the standardized fracturing treatment data is divided in a proportion to obtain a training data set, a verification data set and a test data set. In this embodiment, the standardized fracturing treatment data is divided in 6:2:2. Of course, those skilled in the art may also divide this data in other proportions. The specific division proportion is not limited in the present invention.

In the step S3, the sliding window algorithm is to construct a time window by data of a part of time points in the past, where a number of time points contained in each subsequence is a size of the time window; and move the window forward one or more time units in an entire data set to form a plurality of time windows. Each time window is a subsequence of a time series that may be used as a feature vector for subsequent analysis or machine learning model training.

Figure 2:
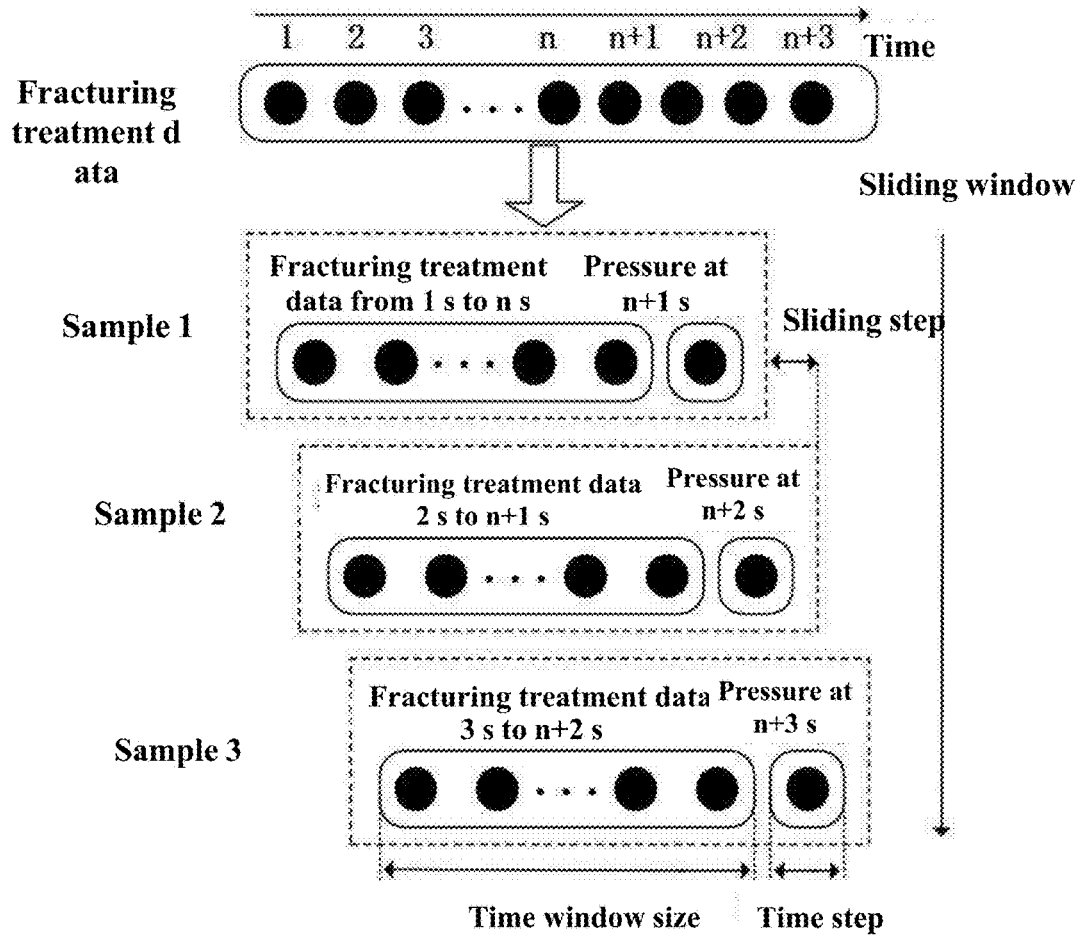
FIG. 2 is a schematic diagram of an implementation of a sliding window algorithm.

For example, as shown in FIG. 2, the fracturing treatment data from the 1st second to the n+3$^{th}$ second may be divided into a data set of samples 1, a data set of samples 2, and a data set of samples 3. The data set of samples 1 is the fracturing treatment data from the 1st second to the nth second and the bottomhole pressure at the n+1th second, the data set of samples 2 is the fracturing treatment data from the 2nd second to the n+1th second and the bottom hole pressure at the n+2th second, the data set of samples 3 is the fracturing treatment data from the 3rd second to the n+2th second and the bottom hole pressure at the n+3th second, and so on. A plurality of pieces of time series data may be obtained for subsequent analysis or training of machine learning models.

In the step S3, the active independent variable is a parameter that may be actively adjusted by an operator to influence the bottomhole pressure, and the active independent variable does not include the bottomhole pressure. Those skilled in the art may select fracturing treatment data and formation evaluation data to combine and construct active independent variable data. In an embodiment, the active independent variable may include only fracturing treatment data or formation evaluation data. For example, the active independent variable is pump rate, proppant concentration and proppant ratio corresponding to each time point, and these three parameters are also parameters mainly required to be adjusted in the subsequent prediction.

Figure 3:
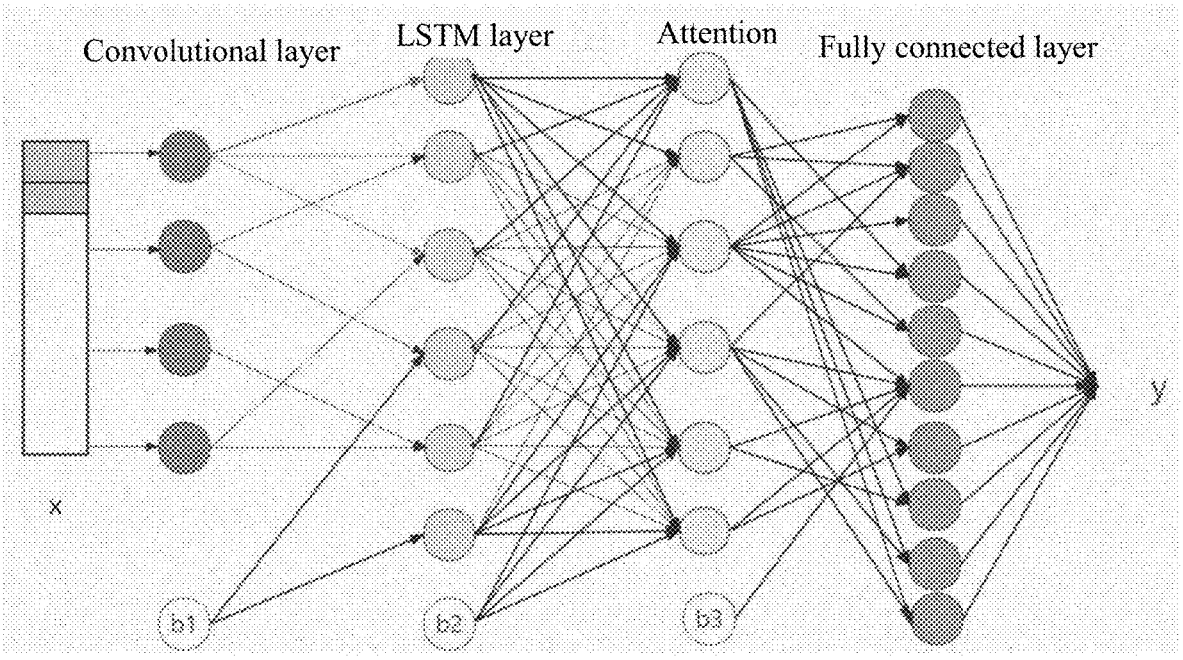
FIG. 3 is a schematic diagram of a structure of a CNN-LSTM-Attention model.

The CNN-LSTM-Attention hybrid neural network model in the step S4 integrates three strong components: a CNN (convolutional neural network) unit, an LSTM (long short-term memory) units, and an attention mechanism. FIG. 3 is a schematic diagram of a structure of a CNN-LSTM-Attention model. The CNN-LSTM-Attention model includes an input layer, a convolution layer, an LSTM layer, an Attention layer, a fully connected layer, and an output layer. The CNN unit in this model is responsible for extracting important spatial features from the input data, and is particularly suitable for processing data with significant spatial structures, such as images or shaped time series data. The LSTM unit is responsible for processing time series data and is excellent at capturing and memorizing both long-term and short-term temporal dependencies in the data. In addition, the added Attention mechanism can further enhance the performance of the model. The Attention mechanism improves the sensitivity and processing capabilities of the model for key information by giving this model the capability to focus on the most important parts of the input data. This enables the entire network to not only effectively process data with complex spatial and temporal features, but also adaptively focus on the most critical parts of these features, thus further improving the prediction or classification accuracy of the model.

The CNN convolution unit includes a convolution layer and a pooling layer. The calculation formula of the convolution layer is:

$$F_{conv}=\mathrm{ReLU}(W*X+b) \tag{2}$$

where W is a weight of a convolution kernel, X is input data, b is a bias term, * represents convolution operation, and ReLU is an activation function.

Data processed by the convolutional layer enters the pooling layer for reducing feature dimensions and also helping to extract more robust features. A maximum pooling operation is usually selected, and the formula is as follows:

$$P_{ij} = \max_{m,n\in[1,k]} X_{i+m,j+n} \tag{3}$$

where $P_{ij}$ is a feature element after pooling, $X_{i+m,j+n}$ is a feature element in the pooling window, and the maximum pooling operation selects the maximum value in the area the operation covers.

After the processed by the CNN convolution unit, the data is reconstructed into a format suitable for LSTM input, and the calculation formula of a forget gate in the long short-term memory (LSTM) neural network is as follows:

$$f_t=\sigma(W_f\cdot[h_{t-1},x_t]+b_f) \tag{4}$$

where $f_t$ represents output of the forget gate, $W_f$ and $b_f$ are related parameters, $\sigma$ represents sigmoid function, $h_{t-1}$ is hidden state at a previous moment, and $x_t$ is input at a current moment;

the input gate consists of two parts: a sigmoid function for determining the information to be updated, and a tanh function for calculating new candidate values, the calculation formula of which is as follows:

$$i_t=\sigma(W_i\cdot[h_{t-1},x_t]+b_i) \tag{5}$$

$$\tilde{C}_t=\tanh(W_c\cdot[ht-1,x_t]+b_c) \tag{6}$$

where $i_t$ represents output of the input gate, $\tilde{C}_t$ represents a candidate value, and $W_i$, $W_c$, $b_i$, and be are related parameters;

the cell state update formula is:

$$C_t=f_t*C_{t-1}+i_t*\tilde{C}_t \tag{7}$$

where $C_t$ represents cell state at a current moment, and $C_{t-1}$ represents cell state at a previous moment;

the output gate determines which part of the cell state is used as the output of the LSTM unit, and the formula is as follows:

$$o_t=\sigma(W_o\cdot[h_{t-1},x_t]+b_o) \tag{8}$$

$$h_t=o_t*\tanh(C_t) \tag{9}$$

where the output of the LSTM unit at the current moment is generated by multiplying a sigmoid function by a tanh value of the cell state, and ht is the input data of the attention layer;

the attention mechanism calculates an attention score for each time step in the sequence, the score measures the relative importance of the hidden state of the time step on the entire sequence, and the calculation formula of the attention score data is as follows:

$$s_T=w_a\tanh(w_ah_t+b_a) \tag{10}$$

where $s_T$ is attention score data, $w_a$ is an attention mechanism weight vector, $h_t$ is an output result of the long short-term memory unit at moment T, and $b_a$ is an attention mechanism bias vector;

these attention scores are then converted to probability distributions (i.e., attention weights) with the softmax function, and the attention probability distribution value at moment T is calculated by:

$$\lambda_t=\frac{\exp(s_t)}{\sum_{t=1}^{N}\exp(s_t)} \tag{11}$$

where $\lambda_T$ is the attention probability distribution value at moment t, which is between 0 and 1 and represents the importance at moment t. Exp is an exponential function with the natural constant e as the base.

Finally, the hidden state of each time step is multiplied by a corresponding attention weight, and then summed over all time steps to obtain the final weighted feature representation. The weighting formula is:

$$r=\sum_{t=1}^{T}\lambda_th_t \tag{12}$$

where r is the weighted feature representation, $\lambda_t$ is an attention probability distribution value, and $h_t$ is an output value of the LSTM unit.

In the step S4, the LightGBM gradient boosting model is an efficient gradient boosting framework, which is an integrated learning method based on a decision tree algorithm, and minimizes a loss function by iteratively adding a decision tree. The LightGBM shows higher efficiency and lower memory consumption when processing a large data set;

the basic formula of gradient boosting is:

$$F_t(x)=F_{t-1}(x)+\alpha\cdot f_t(x) \tag{13}$$

where $F_t(x)$ is a model after the tth iteration, $F_{t-1}(x)$ is a model after the $t-1^{th}$ iteration, $\alpha$ is a learning rate, and $f_t(x)$ is a newly added tree.

In each round of iteration, the loss function L is selected and a negative gradient of the loss function relative to the output of the model is calculated, which is used as a training target of a new tree. The calculation formula of the negative gradient is:

$$g_i=-\frac{\partial L(y_i,F(x_i))}{\partial F(x_i)} \tag{14}$$

where $g_i$ is the negative gradient, L is the loss function, $F(x_i)$ is an output result of the current iteration model, and $x_i$ $y_i$ is a corresponding data point.

The LightGBM gradient boosting model also reduces data dimensions with GOSS and EFB technologies and better processes large-scale data sets.

In the step S7, the root mean square error is a common indicator for measuring a difference between a model prediction value and an actual observed value. The formula is:

$$\sigma_{RMSE}=\sqrt{\frac{1}{n}\sum_{i=1}^{n}(y_i-\hat{y}_i)^2} \tag{15}$$

where $y_i$ is a true value at the ith time point, and $\hat{y}_i$ is a prediction value at the ith time point.

The formula of calculating the weights of the models with a backpropagation method in the step S7 is:

$$W_{lstm}=\frac{\frac{1}{\sigma_{lstm}}}{\frac{1}{\sigma_{lstm}}+\frac{1}{\sigma_{lgbm}}} \tag{16}$$

$$W_{lgbm}=\frac{\frac{1}{\sigma_{lgbm}}}{\frac{1}{\sigma_{lstm}}+\frac{1}{\sigma_{lgbm}}} \tag{17}$$

Where $\sigma_{lstm}$ and $\sigma_{lgbm}$ are root mean square errors of the LSTM model and the LightGBM gradient boosting model in the previous round of prediction, respectively, and $W_{lstm}$ and $W_{lgbm}$ are the weighted proportions of the prediction values of the two models, respectively.

The final prediction value in the step S7 is the prediction value of the two models multiplied by the corresponding weights, and the calculation formula is:

$$\hat{y}=\hat{y}_{lstm}*W_{lstm}+\hat{y}_{lgbm}*W_{lgbm} \tag{18}$$

where $\hat{y}_{lstm}$ and $\hat{y}_{lgbm}$ are the prediction values of the LSTM model and the LightGBM gradient boosting model respectively, and $\hat{y}$ is the final prediction value.

The specific operation of adjusting the active independent variable in the step S8 is:

(S81) obtaining pump rate, proppant concentration, proppant ratio and formation evaluation data of n pieces of data (n>0) before a time point predicted backward, and taking mean values of the pump rate, the proppant concentration and the proppant ratio;

(S82) setting active variable pump rate, proppant concentration and proppant ratio of m time points (m>0) predicted backward as the mean values obtained in the step (S81), remaining the formation evaluation data unchanged, and inputting into a LightGBM gradient boosting model for prediction; and (S83) when predicted pressure trends under different fracturing treatment parameters need to be observed, adjusting the mean values obtained in the step (S81) and inputting the average values into the LightGBM gradient boosting model for prediction.

The dynamic prediction method for surface pump pressure based on spatio-temporal data features in the embodiment of the present invention not only improves the prediction precision, but also enhances the controllability and flexibility of the operation process, which provides a safer and more efficient solution for hydraulic fracturing operation.

The existing surface pump pressure is obtained generally by real-time measurement with a sensor. However, this method has the defects that sand plug may occur when the fracturing treatment parameters (such as pump rate and proppant ratio) are adjusted. In this case, although the surface pump pressure may be monitored in real time, sand plug has already occurred, which will cause a lot of troubles (such as shutdown, and increased economic cost and time cost). Therefore, the embodiment of the present invention establishes a prediction method, through which the change of the surface pump pressure in the future period may be predicted at the current moment, so that sand plug may be prevented in advance by this method.

Based on the foregoing dynamic prediction method for surface pump pressure based on spatio-temporal data features provided in the embodiment of the present invention, an embodiment of the present invention further provides a computer device, where the forgoing method is executed on the computer device. A computer device may include one or more processors, such as one or more central processing units (CPUs) or graphics processors (GPUs), each of which may implement one or more hardware threads. The computer device may also include any memory for storing any type of information such as code, settings, and data. In a specific implementation, a computer program on the memory and executable on the processor, when the computer program is executed by the processor, may execute instructions according to the foregoing method.

For example, without limitation, the memory may include any one or a combination of the following: any type of RAM, any type of ROM, a flash memory device, a hard disk, an optical disk, and the like. More generally, any memory may store information with any technology. Further, any memory may provide volatile or non-volatile retention of information. Further, any memory may represent fixed or removable components of the computer device. In one case, when a processor executes associated instructions stored in any memory or combination of memories, the computer device may perform any of the operations of the associated instructions. The computer device further includes one or more drive mechanisms, such as a hard disk drive mechanism and an optical disk drive mechanism, for interacting with any of the memories.

Corresponding to the dynamic prediction method for surface pump pressure provided in the embodiment of the present invention, an embodiment of the present invention further provides a computer-readable storage medium, where a computer program is stored on the computer-readable storage medium, and the computer program, when executed by a processor, performs the steps of the method.

An embodiment of the present invention further provides a computer readable instruction, where when the instruction is executed by a processor, a program therein enables the processor to execute the method.

APPLICATION EXAMPLE

In a specific implementation, the prediction method provided in the embodiment of the present invention is practically applied to a certain well with sand plug in a certain block and optimizes the fracturing treatment scheme of the certain well, which specifically includes the following steps:

S1. Original fracturing treatment data of a complete fracturing treatment cycle of a plurality of wells and formation evaluation data of a corresponding fracturing formation are obtained. The original fracturing treatment data at least includes bottomhole pressure, pump rate, proppant ratio, cumulative proppant volume, cumulative fluid volume, and other parameters. The formation evaluation data at least include maximum horizontal principal stress, minimum horizontal principal stress, formation pressure, pore pressure, vertical stress, Poisson's ratio, Young's modulus and other parameters.

Table 1 shows some of the original fracturing treatment data.

TABLE 1

| Time HH:mm:ss | Pump rate $m^3$/min | Proppant ratio % | Bottomhole pressure MPa | Proppant concentration kg/$m^3$ | Cumulative fluid volume $m^3$ | Cumulative proppant volume $m^3$ |
|---|---|---|---|---|---|---|
| 14:19:19 | 5.91 | 24.23 | 66.91544 | 351.33 | 196.35 | 15.66 |
| 14:19:20 | 5.93 | 24.13 | 66.86206 | 349.88 | 196.44 | 15.68 |
| 14:19:21 | 5.94 | 24.23 | 66.76449 | 351.33 | 196.54 | 15.71 |
| 14:19:22 | 5.92 | 24.12 | 66.80341 | 349.74 | 196.64 | 15.73 |
| 14:19:23 | 5.92 | 24.17 | 66.78268 | 350.46 | 196.74 | 15.76 |
| 14:19:24 | 5.91 | 24.19 | 66.91034 | 350.75 | 196.84 | 15.78 |
| 14:19:25 | 5.91 | 24.12 | 67.01598 | 349.74 | 196.94 | 15.8 |
| 14:19:26 | 5.9 | 24.16 | 67.14612 | 350.32 | 197.04 | 15.83 |
| 14:19:27 | 5.91 | 24.12 | 67.11291 | 349.74 | 197.13 | 15.85 |
| 14:19:28 | 5.94 | 24.24 | 66.88768 | 351.48 | 197.23 | 15.87 |
| 14:19:29 | 5.94 | 24.22 | 66.81994 | 351.19 | 197.33 | 15.9 |
| 14:19:30 | 5.92 | 24.16 | 66.8384 | 350.32 | 197.43 | 15.92 |
| 14:19:31 | 5.91 | 24.22 | 66.92149 | 351.19 | 197.53 | 15.95 |
| 14:19:32 | 5.9 | 24.23 | 66.92404 | 351.33 | 197.63 | 15.97 |
| 14:19:33 | 5.9 | 24.13 | 66.88417 | 349.88 | 197.73 | 15.99 |
| 14:19:34 | 5.9 | 24.15 | 66.81146 | 350.17 | 197.82 | 16.02 |
| 14:19:35 | 5.91 | 24.23 | 66.76211 | 351.33 | 197.92 | 16.04 |

TABLE 1-continued

| Time HH:mm:ss | Pump rate $m^3$/min | Proppant ratio % | Bottomhole pressure MPa | Proppant concentration kg/$m^3$ | Cumulative fluid volume $m^3$ | Cumulative proppant volume $m^3$ |
|---|---|---|---|---|---|---|
| 14:19:36 | 5.93 | 24.28 | 66.78697 | 352.06 | 198.02 | 16.07 |
| 14:19:37 | 5.91 | 24.14 | 66.99367 | 350.03 | 198.12 | 16.09 |
| 14:19:38 | 5.92 | 24.12 | 67.01982 | 349.74 | 198.22 | 16.11 |

Table 2 shows some formation evaluation parameters corresponding to a certain fracturing formation.

TABLE 2

| Poisson's ratio Dimensionless | Young's modulus MPa | Formation pressure MPa | Maximum horizontal principal stress MPa | Minimum horizontal principal stress MPa | Pore pressure MPa | Vertical stress MPa |
|---|---|---|---|---|---|---|
| 0.25 | 24965.12 | 29.26 | 85.66 | 69.69 | 29.26 | 88.01 |

S2. The complete fracturing treatment cycle is divided into different intervals according to the fracturing treatment data, and fracturing treatment data is extracted from a prepad fluid initiation stage to a shut-down stage.

As shown in Table 3, the complete fracturing treatment cycle of a certain well is divided into 5 stages of pressure test, prepad fluid, sand carrying fluid, after pad fluid and shut-down.

TABLE 3

| Time HH:mm:ss | Operation Content | Oil pressure MPa | Casing pressure MPa | Pump rate $m^3$/min | Proppant ratio % | Proppant concentration kg/m3 | Cumulative fluid volume $m^3$ | Total proppant volume $m^3$ |
|---|---|---|---|---|---|---|---|---|
| 09:48:54 | Start | 0 | 0.45 | 0 | 0 | 0 | 0 | 0 |
| 09:49:54 | Pressure testing | 0 | 35.44 | 0 | 0 | 0 | 0 | 0 |
| 09:50:54 | | 0 | 70.14 | 0 | 0 | 0 | 0 | 0 |
| 09:52:54 | | 0 | 69.98 | 0 | 0 | 0 | 0 | 0 |
| 09:56:54 | | 0 | 0 | 0 | 0 | 0 | 0 | 0 |
| 10:51:54 | Prepad fluid | 0 | 0.33 | 0.04 | 0 | 0 | 0 | 0 |
| 10:52:54 | | 0 | 40.73 | 1.2 | 0 | 0 | 0.57 | 0 |
| 10:54:54 | | 0 | 48.8 | 3.75 | 0 | 0 | 5.62 | 0 |
| 10:58:54 | | 0 | 47.49 | 4.37 | 5.01 | 72.65 | 22.07 | 0.46 |
| 11:00:54 | | 0 | 46.77 | 4.23 | 0 | 0 | 30.55 | 0.81 |
| 11:02:54 | Sand carrying fluid | 0 | 46.66 | 4.23 | 9.03 | 130.94 | 39.05 | 0.95 |
| 11:05:54 | | 0 | 46.15 | 4.23 | 12.01 | 174.15 | 51.72 | 2.23 |
| 11:09:54 | | 0 | 44.93 | 4.17 | 20.16 | 292.32 | 68.56 | 4.72 |
| 11:12:54 | | 0 | 44.66 | 4.18 | 20.14 | 292.03 | 81.15 | 7.26 |
| 11:16:54 | | 0 | 44.59 | 4.19 | 26.94 | 390.63 | 97.88 | 11.17 |
| 11:18:54 | After pad fluid | 0 | 45.81 | 4.3 | 0 | 0 | 106.3 | 12.05 |
| 11:19:54 | | 0 | 46.81 | 4.23 | 0 | 0 | 110.55 | 12.05 |
| 11:24:54 | | 0 | 52.77 | 4.16 | 0 | 0 | 131.67 | 12.05 |
| 11:27:54 | | 0 | 38.23 | 0.07 | 0 | 0 | 140.94 | 12.05 |
| 11:28:54 | Shut-down | 0 | 34.82 | 0 | 0 | 0 | 140.94 | 12.05 |

S3. The obtained fracturing treatment data is preprocessed, time series data is constructed with a sliding window algorithm, the fracturing treatment data with the bottomhole pressure removed is preprocessed and then constructs active independent variable data with the formation evaluation data. In the application example, the pump rate, proppant concentration and proppant ratio are selected as the active independent variable data.

For example, in this embodiment, a size of the time window is set to 180, a size of the sliding window is set to 5, and a size of the time step is set to 60.

S4. A CNN-LSTM-Attention hybrid neural network model for receiving the time series data and a LightGBM gradient boosting model for receiving the active independent variable data are constructed.

The initial parameters of the CNN-LSTM-Attention hybrid neural network model are shown in Table 4.

TABLE 4

| Model structure | Parameter |
|---|---|
| Sequence input layer | Dimension of input data |
| Neural units in convolutional layer | Obtained by optimization |
| Number of neural units in long short-term memory layer | Obtained by optimization |
| Number of neural units in Attention layer | Obtained by optimization |
| Fully connected layer | Dimension of output data |
| Learning rate | Obtained by optimization |
| Maximum number of training rounds | Obtained by optimization |

The initial parameters of the LightGBM gradient boosting model are shown in Table 5.

TABLE 5

| Model structure | Parameter |
|---|---|
| Number of trees | Obtained by optimization |
| Maximum depth of tree | Obtained by optimization |
| Proportion of samples used to train each tree to the total samples | Obtained by optimization |
| Proportion of features used in constructing each tree | Obtained by optimization |
| Learning rate | Obtained by optimization |

S5. The CNN-LSTM-Attention hybrid neural network model and the LightGBM gradient boosting model are respectively trained with the time series data and the active independent variable obtained, and hyperparameter optimization is performed on the model training process with a Bayesian optimization algorithm.

When training the model, to comprehensively evaluate the performance of the model, this embodiment uses the following indicators for comprehensive evaluation:

(1) Mean absolute percentage error (MAPE), whose value range is [0, +∞).

$$MAPE = \frac{100\backslash\%}{N}\sum_{i=1}^{N}\left|\frac{\hat{y}_i - y_i}{y_i}\right| \tag{19}$$

(2) mean absolute error (MAE), whose value range is [0, +∞).

$$MAE = \frac{1}{N}\sum_{i=1}^{N}|\hat{y}_i - y_i| \tag{20}$$

(3) Mean square error (MSE), whose value range is [0, +∞).

$$MSE = \frac{1}{N}\sum_{i=1}^{N}(\hat{y}_i - y_i)^2 \tag{21}$$

$y_i$ is the actual bottomhole pressure, $\hat{y}_i$ and is the bottomhole pressure predicted by the model. The smaller the above three indicators, MAPE, MAE, and MSE, the better the model fitting effect.

Figure 4:
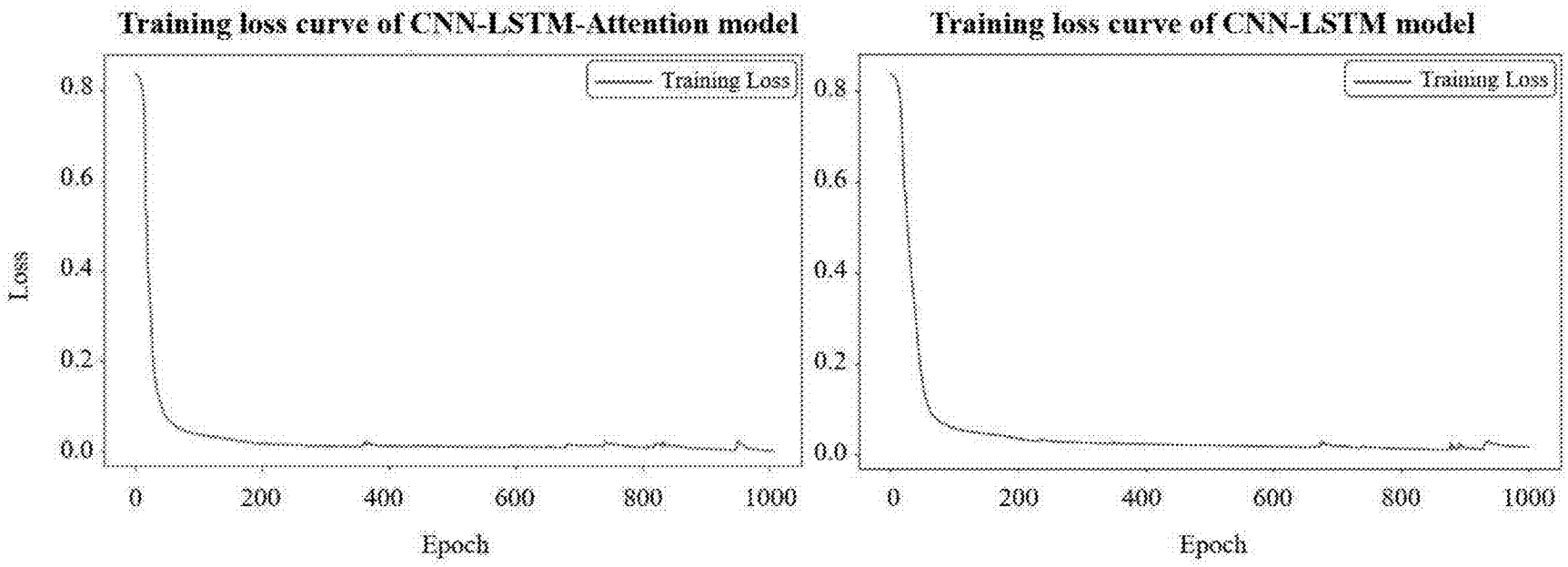
FIG. 4 is a loss curve of a CNN-LSTM-Attention model and a CNN-LSTM model during the training process.

In this embodiment, FIG. 4 is a schematic diagram comparing the decrease of the loss function during CNN-LSTM-Attention and CNN-LSTM training. It may be seen from FIG. 4 that, during the training of CNN-LSTM-Attention and CNN-LSTM, the loss function may decrease relatively steadily and finally converge, but the model with the attention mechanism (i.e., the CNN-LSTM-Attention model) has a faster decrease in loss and finally converges to a smaller loss value.

In this embodiment, the hyperparameter optimization of the model training process is performed with a Bayesian optimization algorithm. Bayesian optimization is an effective method for global optimization, especially for costly function evaluation scenarios. The specific process is as follows:

(I) Selecting a prior distribution: Bayesian optimization first selects a prior distribution to represent the objective function. This distribution is usually Gaussian because this distribution allows a good estimate of the function value and uncertainty. (II) Collecting initial data points: Before the iteration, some initial data points need to be collected. These data points may be chosen randomly or based on some heuristic method. (III) Updating the posterior distribution: The posterior distribution is updated with the initial data points and the prior distribution by the Bayesian rule. The posterior distribution combines prior knowledge and observed data and reflects the current best estimate of the objective function. (IV) Selecting the next point for evaluation. (V) Performing function evaluation. (VI) Repeating the updating posterior distribution. (VII) Selecting the optimal solution.

After the optimization process is finished, the optimal solution is selected according to the posterior distribution. This is usually the point where the function value is maximized or the optimal point actually evaluated, that is, the optimal hyperparameter for the model.

Figure 5:
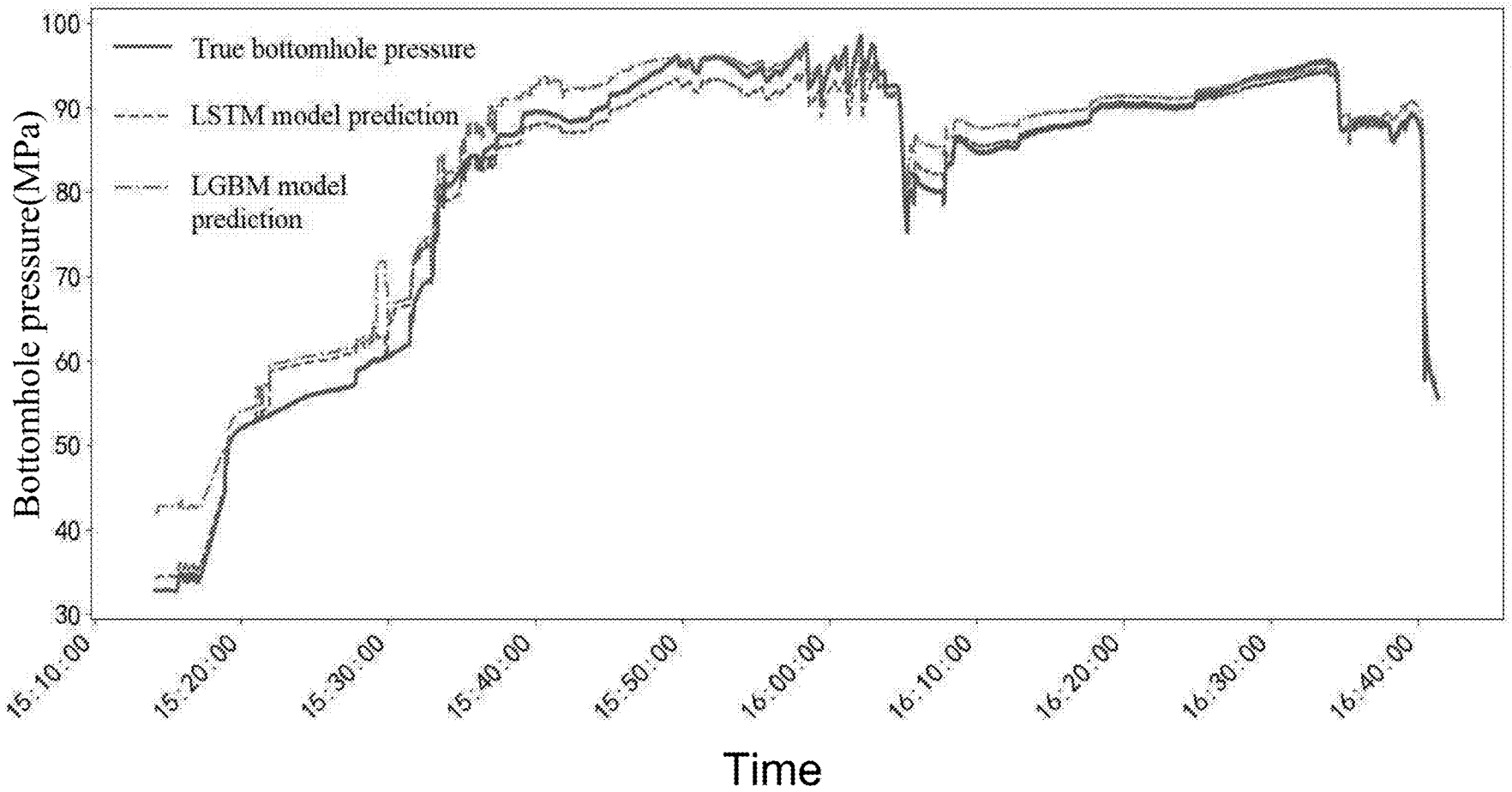
FIG. 5 is a diagram of a comparison between prediction values and true values of a CNN-LSTM-Attention and a Light GBM gradient boosting model on a test set.

FIG. 5 shows the prediction effects of the CNN-LSTM-Attention model and the LightGBM model in this embodiment on the test set after obtaining the optimal hyperparameter. The relative errors of the two models are 3.84% and 2.18% respectively.

S6. Fracturing treatment data and formation evaluation data of a new fracturing well are obtained, and future multi-step prediction is performed on the bottomhole pressure with the trained models at a sand carrying fluid initiation stage.

Figure 6:
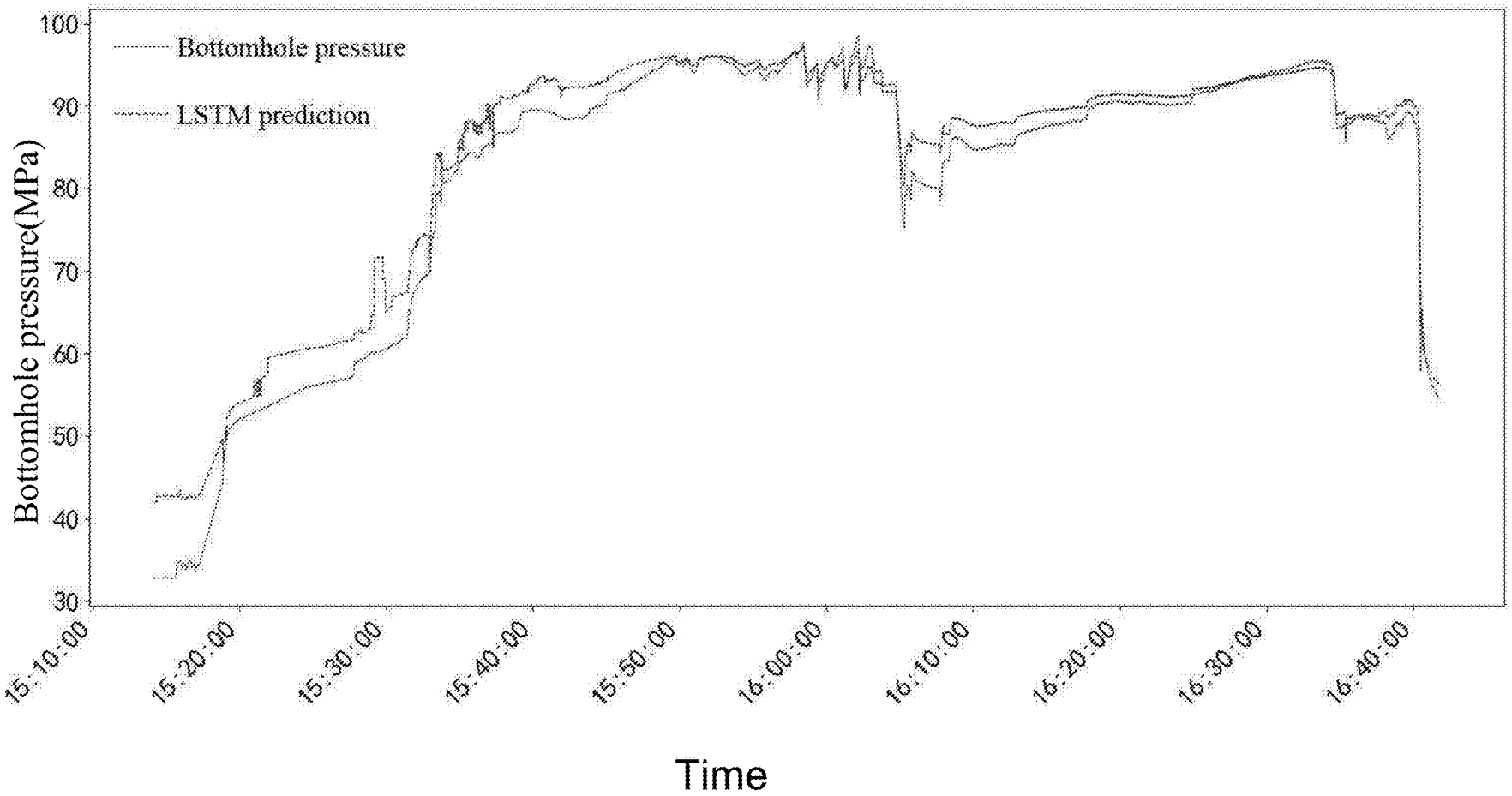
FIG. 6 is a diagram of a comparison between a prediction value and a true value of a prediction method according to the present invention on a target well.

The pressure prediction effect of the prediction model in the sand carrying fluid stage in the new well is shown in FIG. 6. The final prediction is obtained by weighting the prediction values of the two models. The relative error between the prediction value and the actual value is 1.21%. Compared with the prediction result of FIG. 5, the prediction accuracy is effectively improved, which has certain guiding significance for on-site fracturing treatment decision-making.

S7. The weights of prediction results of the two models are initialized, the root mean square errors of the two models are separately calculated according to prediction results of each round and a real pressure, and the weights of the prediction results of the two models are updated and iterated with a backpropagation method, so as to obtain a more balanced and accurate final prediction value.

Figure 7:
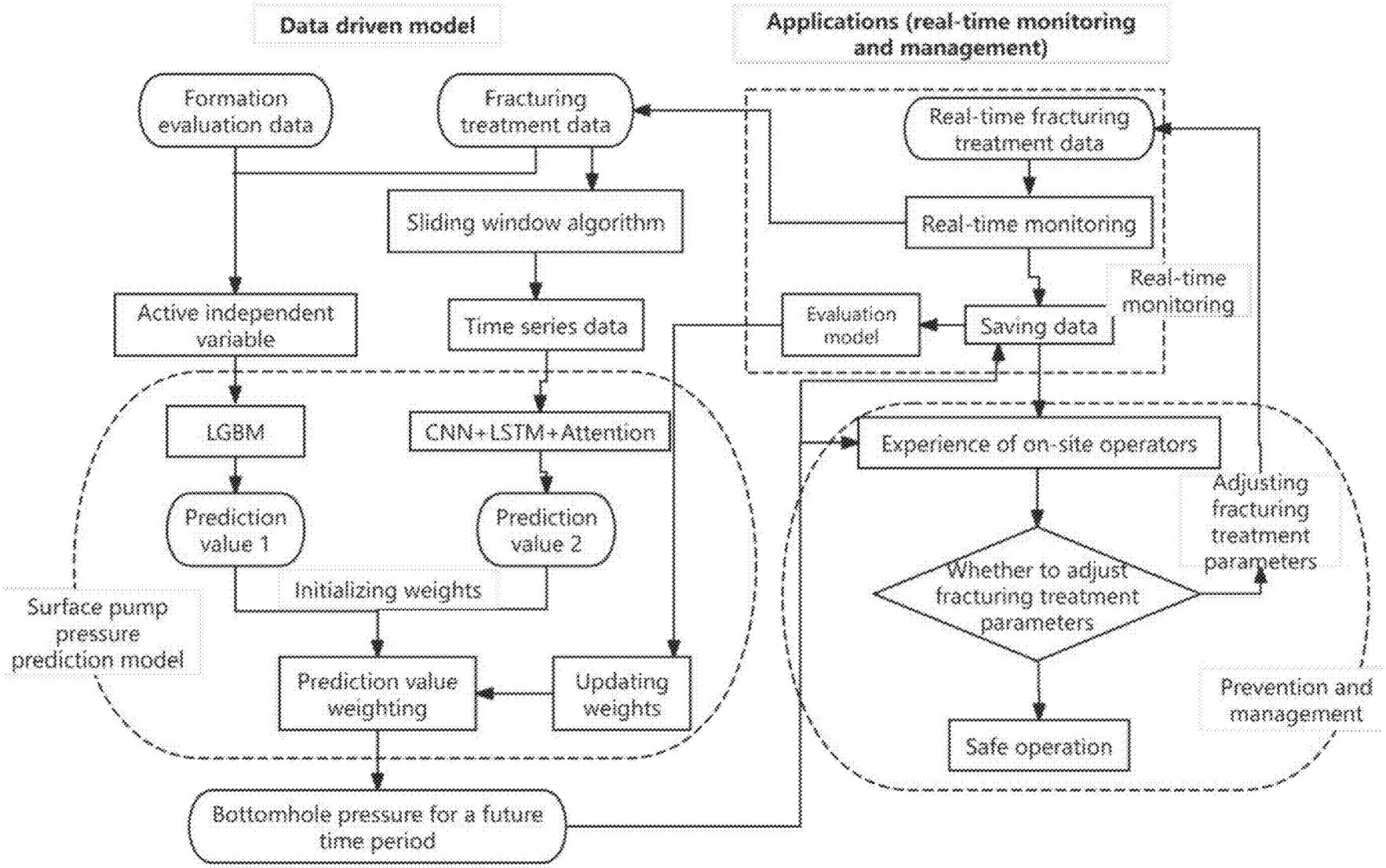
FIG. 7 is a flow chart of practical application of a dynamic prediction model for surface pump pressure.

The flowchart of initializing the model weights, updating the model weights and obtaining the final prediction value is shown in FIG. 7. The idea of gradient decrease is used to modify and adjust the model weights in real time to achieve more accurate predictions.

S8. The active independent variable is modified and future predicted pressure is checked to achieve bottomhole pressure regulation and provide a fracturing treatment optimization suggestion.

As shown in FIG. 7, in the embodiment of the present invention, formation evaluation data and fracturing treatment data of a target block are collected first, a time series of the fracturing treatment data is obtained with a sliding window algorithm, the preprocessed fracturing treatment data and formation evaluation data are combined to construct active independent variable data, a CNN-LSTM-Attention model is constructed to receive the time series, a LightGBM model is constructed to receive the active independent variable data, and prediction values of the two models are weighted and optimized to obtain a bottomhole pressure in a future period of time. In the prediction process, model evaluation and weight updating may be performed by real-time monitoring fracturing treatment data, so that the prediction model is continuously optimized. Meanwhile, with the predicted bottomhole pressure, on-site operators may also evaluate whether there is a risk of sand plug when adjusting fracturing treatment parameters, thereby providing prevention and management methods for on-site fracturing treatment and ensuring the safety and economic benefits of oil and gas field development.

The principle and implementation of the present invention are described herein by using specific examples. The descriptions about embodiments of the present invention are merely provided, to help understand the method and core ideas of the present invention. In addition, those of ordinary skill in the art can make variations and modifications to the present invention in terms of the specific implementations and application scopes according to the ideas of the present invention. Therefore, the content of specification shall not be construed as a limit to the present invention.

What is claimed is:

1. A hydraulic fracturing method, comprising:

checking a fracturing truck to ensure clearance of a ground pipeline;

starting a high-pressure pump of the fracturing truck and testing pressure bearing performance of equipment above a wellhead valve and the ground pipeline;

starting the fracturing truck and extruding fracturing fluid into a formation based on a pump rate;

injecting sand carrying fluid including the fracturing fluid and a proppant;

pushing the sand carrying fluid in a tubing or a casing into the formation; and dynamically predicting a surface pump pressure based on spatio-temporal data features and adjusting abnormal bottomhole pressure in time, wherein dynamically predicting a dynamic prediction method for surface pump pressure based on spatio-temporal data features, the dynamic prediction method is applied in predicting and adjusting an abnormal bottomhole pressure in time comprises the following steps:

S1: obtaining original fracturing treatment data of a complete fracturing treatment cycle of a plurality of wells and formation evaluation data of a corresponding fracturing formation, wherein the fracturing treatment data in the step S1 comprises: the pump rate, proppant concentration and proppant ratio; the formation evaluation data comprises maximum horizontal principal stress, minimum horizontal principal stress, formation pressure, pore pressure, and vertical stress, wherein the pump rate is obtained by a fracturing pump; the formation pressure and the pore pressure are obtained by a Drill Stem Testing, (DST) drill pipe testing tool;

S2: dividing the complete fracturing treatment cycle into different intervals according to the original fracturing treatment data, and extracting fracturing treatment data from a prepad fluid initiation stage to a shut-down stage;

S3: preprocessing the fracturing treatment data obtained in the step S2, constructing time series data with a sliding window algorithm, preprocessing and then combining the fracturing treatment data and formation evaluation data to construct active independent variable data, wherein the active independent variable data is data that is actively adjusted to influence bottomhole pressure;

S4: establishing a Convolutional Neural Network-Long Short-Term Memory, (CNN-LSTM)-Attention hybrid neural network model for receiving the time series data and establishing a Light Gradient Boosting Machine, (LightGBM) gradient boosting model for receiving the active independent variable data;

S5: training the CNN-LSTM-Attention hybrid neural network model with the time series data obtained in the step S3, training the LightGBM gradient boosting model with the active independent variable data, and performing hyperparameter optimization on the training process;

S6: obtaining fracturing treatment data and formation evaluation data of a new fracturing well, and performing future multi-step prediction on the bottomhole pressure with the models trained in the step S5 at a sand carrying fluid initiation stage;

S7: initializing weights of prediction results of the CNN-LSTM-Attention hybrid neural network model and the LightGBM gradient boosting model, separately calculating errors of the two models according to prediction results of each round and a real pressure, and optimizing the weights of the prediction results of the two models to obtain a prediction value of the surface pump pressure;

determining that the predicted pressure is abnormal; and during a hydraulic fracturing construction, adjusting construction parameters in advance upon determination that the predicted pressure is abnormal, to avoid sand plugging.

2. The hydraulic fracturing method according to claim 1, wherein the preprocessing obtained fracturing treatment data in the step S3 to obtain preprocessed data comprises the following steps:

S31: deleting null values and interpolating missing value data;

S32: standardizing the fracturing treatment data; and

S33: dividing the standardized fracturing treatment data in a certain proportion to obtain a training data set, a verification data set and a test data set.

3. The hydraulic fracturing method according to claim 1, wherein the constructing time series data with a sliding window algorithm in the step S3 comprises the following steps:

constructing a time window by data of a part of time points in the past, wherein a number of time points contained in each subsequence is a size of the time window; and moving the time window forward one or more time units in an entire data set to form a plurality of time windows.

4. The hydraulic fracturing method according to claim 1, wherein the active independent variable data in the step S3 comprises pump rate, proppant concentration, and proppant ratio.

5. The hydraulic fracturing method according to claim 1, wherein the weights of the prediction results of the two models are optimized with a backpropagation method in the step S7.

6. The hydraulic fracturing method according to claim 1, further comprising:

S8: modifying the active independent variable and checking predicted surface pump pressure.

7. The hydraulic fracturing method according to claim 6, wherein the step S8 further comprises:

S81: obtaining pump rate, proppant concentration, proppant ratio and formation evaluation data of n pieces of data before a time point predicted backward, and taking mean values of the pump rate, the proppant concentration and the proppant ratio;

S82: setting active variable pump rate, proppant concentration and proppant ratio of m time points predicted backward as the mean values obtained in the step S81, remaining the formation evaluation data unchanged, and inputting into a LightGBM gradient boosting model for prediction; and S83: when predicted pressure trends under different fracturing treatment parameters need to be observed, adjusting the obtained mean values and inputting the average values into the LightGBM gradient boosting model for prediction.

8. A computer device, comprising: a memory, a processor, and a computer program stored in the memory and running on the processor, wherein the processor, when executing the computer program, implements the steps of the hydraulic fracturing method according to claim 1.

9. A non-transitory computer-readable storage medium, having a computer program stored thereon, wherein the computer program, when executed by a processor, implements the steps of the hydraulic fracturing method according to claim 1.

* * * * *